US011490668B2

(12) United States Patent
Lewis

(10) Patent No.: US 11,490,668 B2
(45) Date of Patent: Nov. 8, 2022

(54) GARMENT

(71) Applicant: Jenny Ruth Lewis, Haslet, TX (US)

(72) Inventor: Jenny Ruth Lewis, Haslet, TX (US)

( * ) Notice: Subject to any disclaimer, the term of this patent is extended or adjusted under 35 U.S.C. 154(b) by 67 days.

(21) Appl. No.: 16/923,273

(22) Filed: Jul. 8, 2020

(65) Prior Publication Data

US 2021/0093025 A1 Apr. 1, 2021

Related U.S. Application Data

(63) Continuation of application No. 15/659,210, filed on Jul. 25, 2017, now abandoned.

(60) Provisional application No. 62/366,273, filed on Jul. 25, 2016.

(51) Int. Cl.

| | |
|---|---|
| ***A41D 19/00*** | (2006.01) |
| ***A41D 3/00*** | (2006.01) |
| ***A41B 1/08*** | (2006.01) |
| ***A41D 19/01*** | (2006.01) |
| ***A41D 27/10*** | (2006.01) |
| ***A41D 27/20*** | (2006.01) |
| *A41D 1/04* | (2006.01) |
| *A41B 1/10* | (2006.01) |
| *A41D 13/00* | (2006.01) |
| *A41D 19/015* | (2006.01) |

(52) U.S. Cl.

CPC ..... *A41D 19/0041* (2013.01); *A41B 1/08* (2013.01); *A41D 3/005* (2013.01); *A41D 19/0013* (2013.01); *A41D 19/01* (2013.01); *A41D 27/10* (2013.01); *A41D 27/201* (2013.01); *A41B 1/10* (2013.01); *A41D 1/04* (2013.01); *A41D 13/00* (2013.01); *A41D 19/0037* (2013.01); *A41D 19/0048* (2013.01); *A41D 19/01529* (2013.01); *A41D 2200/20* (2013.01); *A41D 2300/32* (2013.01); *A41D 2300/322* (2013.01); *A41D 2300/324* (2013.01)

(58) Field of Classification Search

CPC ..... A41B 1/08; A41B 1/10; A41D 19/0041; A41D 19/0013; A41D 19/01; A41D 19/01529; A41D 19/0037; A41D 19/0048; A41D 1/04; A41D 3/005; A41D 27/10; A41D 27/201; A41D 2200/20; A41D 2300/32; A41D 2300/322; A41D 2300/324; A41D 13/00

USPC ..... 2/69, 336, 338

See application file for complete search history.

(56) References Cited

U.S. PATENT DOCUMENTS 1,361,565 A * 12/1920 Christy ..... A41D 19/0041 2/160

1,374,257 A * 4/1921 Van Raalte ..... A41D 19/0013 2/160

1,786,227 A * 12/1930 Bruggeman ..... A41D 19/01 2/158

(Continued)

*Primary Examiner* — Khaled Annis

*Assistant Examiner* — Dakota Marin

(74) *Attorney, Agent, or Firm* — Patrick M. Torre; Stites & Harbison, PLLC

(57) ABSTRACT

A garment including a plurality of attached glove members having releasably attached glove bodies is provided. The garment includes a central portion and two opposed sleeve portions. Each attached glove member is attached to each opposed sleeve portion through the use of a retainer. The glove members may be used separately or together, allowing the user to deploy a combination of glove members simultaneously.

14 Claims, 8 Drawing Sheets

(56) References Cited

U.S. PATENT DOCUMENTS 2,136,879 A * 11/1938 Haber ..... A41D 27/10 2/270
2,274,510 A * 2/1942 Wohl ..... A41D 19/0041 D2/614
2,323,136 A * 6/1943 Johanson ..... A41D 19/01 2/907
2,340,017 A * 1/1944 Rasmussen ..... A41D 19/0041 2/270
3,214,771 A * 11/1965 Treiber ..... A41D 27/10 2/270
4,297,746 A * 11/1981 Zarbos ..... A41D 19/0041 2/108
4,733,412 A * 3/1988 Campbell ..... A41D 19/01529 2/164
4,742,580 A * 5/1988 Phillips, Jr. ..... A41D 19/0041 2/907
4,773,100 A * 9/1988 Kuo ..... A41D 27/10 2/232
4,933,992 A * 6/1990 Kallman ..... A41D 19/00 2/160
5,073,988 A * 12/1991 Lewis, Jr. ..... A41D 19/0041 2/270
5,749,098 A * 5/1998 Evans ..... A41D 19/0041 2/124
5,794,265 A * 8/1998 Reich ..... A41D 27/10 2/125
5,950,240 A * 9/1999 Carpenter ..... A41D 19/0041 2/160
6,820,281 B2 * 11/2004 Mariland ..... A41D 13/0015 2/69
7,191,472 B1 * 3/2007 Kishino ..... A41D 19/01 2/163
7,516,499 B2 * 4/2009 Gardner, III ..... A41F 9/025 2/221
7,636,952 B2 * 12/2009 Fordham ..... A41D 19/0006 2/160
8,256,026 B2 * 9/2012 Garrigos ..... A41D 13/0007 70/57.1
8,904,564 B2 * 12/2014 Laycock ..... A41D 19/0041 2/93
2001/0025384 A1 * 10/2001 Kester ..... A45F 4/14 2/93
2003/0079272 A1 * 5/2003 Poppe ..... A41D 27/10 2/114
2003/0233695 A1 * 12/2003 Golde ..... A41D 19/015 2/161.1
2011/0138517 A1 * 6/2011 Ambrosio ..... A41D 19/0024 2/163
2012/0060256 A1 * 3/2012 Parker ..... A41D 19/0041 2/85
2012/0210532 A1 * 8/2012 Slade, Jr. ..... A47L 13/18 15/227
2015/0201681 A1 * 7/2015 Ron ..... A41D 31/12 2/84
2017/0027254 A1 * 2/2017 Myerscough ..... A41D 15/002
2018/0042317 A1 * 2/2018 Cornelius ..... A45F 5/02
2018/0295909 A1 * 10/2018 Carter ..... A41D 19/0041

* cited by examiner

GARMENT

This application is a continuation patent application claiming priority from U.S. patent application Ser. No. 15/659,210 filed on Jul. 25, 2017 which in turn claims priority to U.S. Provisional Application Ser. No. 62/366,273 filed on Jul. 25, 2016, the contents of all of which are hereby incorporated by reference in their entirety.

TECHNICAL FIELD

This disclosure is directed to a garment including a plurality of attached glove structures; in particular, the garment includes several distinct glove structures attached to each sleeve portion thereof.

BACKGROUND

Garments and other similar articles of clothing are rarely fitted with releasably attached glove members. As a result, gloves must be donned separately by an individual. Gloves and other similarly small accessories can be easy to lose, for example when worn by small children.

Additionally, a variety of different types of gloves may be needed for specific activities. In cool weather, or in instances where a user requires increased manual dexterity, a fingerless glove may be appropriate; however, in colder conditions a user may need additional protection and/or warmth for their hand. There would be significant benefit to having multiple gloves accessible as part of a garment is preferred to managing numerous gloves separately.

Accordingly, a need is identified for a garment with several distinct glove structures attached to the sleeves.

SUMMARY

This invention relates to a garment that includes a plurality of glove structures attached thereto. The garment includes a body portion and two opposed sleeve portions. Multiple glove members are attached to each opposed sleeve portion. The glove members may be attached to the sleeve portions by any suitable fastening mechanism.

Each glove member includes a cuff which attaches the glove member to the opposed sleeve portions of the garment and a body configured to cover at least a portion of a user's hand. A plurality of glove member retainers are provided for releasably attaching the body to a one of the sleeve portions. When the body portion of the glove member is released from the sleeve, the cuff portion remains attached, preventing loss of the glove.

The three glove members provided may be used separately or together in any combination. Each individual glove member is capable of being extended to reach a user's hand for wearing while the other members remain secured by the retainer.

In the following description, there are shown and described embodiments of the disclosed garment. As it should be realized, the garment is capable of other, different embodiments and its several details are capable of modification in various, obvious aspects all without departing from the garments as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the disclosed invention, serve to explain certain principles thereof. In the drawing figures.

Reference will now be made in detail to embodiments of the disclosed garment, examples of which are illustrated in the accompanying drawing figures.

DETAILED DESCRIPTION

At a high level, the present disclosure is directed to a garment including a plurality of attached glove structures. In particular, the garment includes several distinct glove structures attached to each sleeve portion thereof. It is contemplated that the garment may be any long-sleeved garment including without intending any limitation a jacket or coat, a sweater, a hoodie, a long-sleeved shirt, a sweatshirt, and others.

Figure 1:
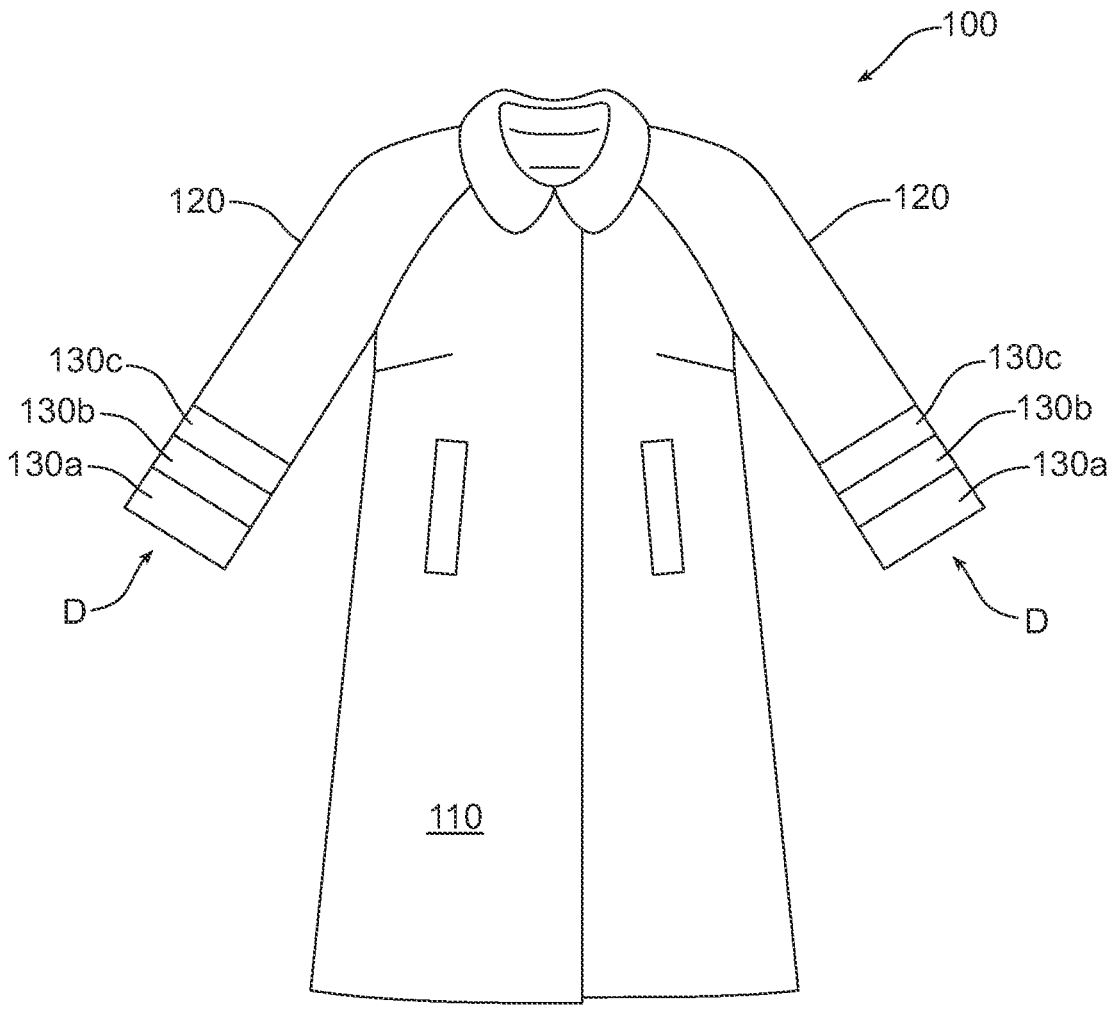
FIG. 1 is a front view of one embodiment of a garment, including three distinct glove members.

In reference to FIG. 1, a garment 100 includes a central or body portion 110 and two opposed sleeve portions 120. The sleeve portions 120 may be dimensioned to end at a user's wrist, or may include cuffs (not shown) dimensioned to cover at least a portion of the back of a user's hand and palm. In this latter embodiment, the cuff may include an aperture adapted to receive a user's thumb therethrough (embodiment not shown), to retain the sleeve in place. Such structures are well known in the art.

A plurality of glove members 130*a* . . . *n* are attached to each opposed sleeve portion 120. In the depicted embodiment, three glove members 130*a*, 130*b*, and 130*c* are attached. However, it will be appreciated that more or fewer glove members 130*a* . . . *n* may be attached. The glove members 130*a* . . . *n* are attached substantially adjacent to a distal end D of each sleeve portion 120. As will be appreciated, by such fastening, a user wearing the garment cannot lose one or more of the attached glove members 130*a* . . . *n*.

The basic structure of a glove (cuff, palm, fingers, etc.) is well known in the art and does not require extensive description herein. However, in more detail and as shown in FIGS. 2A-2D, each glove member 130*a* . . . *n* includes a cuff portion 140 which attaches to the garment sleeve portion 120 by any suitable substantially non-releasable method, such as stitching, adhesives, and other non-releasable methods. Each glove member 130*a* . . . *n* also includes a body portion 150*a* . . . *n* which defines the type of glove structure provided. The cuff portion 140 and body portion 150*a* . . . *n* may be fabricated of any suitable material, including natural materials, synthetic materials, or blends, and further may be fully or partially fabricated of waterproof or water-resistant materials. In turn, the cuff portion 140 and/or body portion 150*a* . . . *n* may be lined with any suitable natural material, synthetic material, or blend, for example fleece materials.

Figure 3:
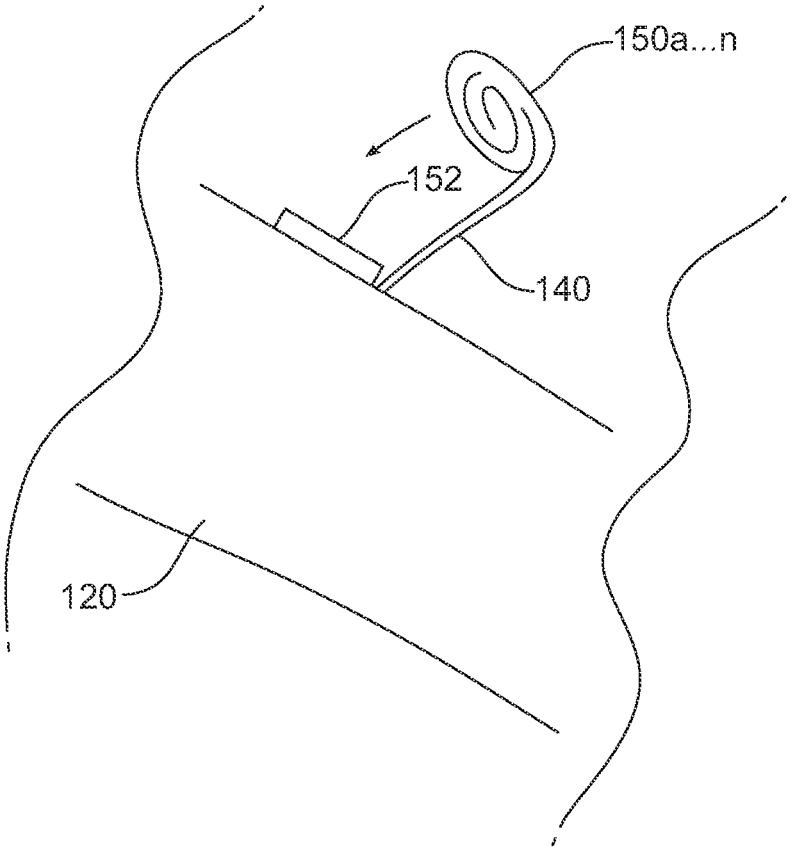
FIG. 3 shows a glove member folded or rolled for attaching to a glove member retainer for stowing.

As will be appreciated, the cuff portion 140 will be dimensioned to be sufficiently long as to allow the body portion 150*a* . . . *n* to reach a user's hand for wearing. The cuff portion 140 may be configured to encircle a portion of a user's arm/wrist as depicted, or may simply be a strip of material which attaches the glove members 130*a* . . . *n* to the sleeve portion 120. In use, the body portion 150*a* . . . *n* is detached from the sleeve 120, the cuff portion 140 remaining attached to prevent loss of the glove member 130*a* . . . *n*, and the body portion is slipped onto the user's hand and palm and/or the fingers (see discussion below). As will be appreciated, to accomplish this the body portion 150*a* . . . *n* is releasably attached to one or both of the cuff portion 140 or the sleeve 120 by a glove member retainer 152 (see FIG. 3). The glove member retainer 152 may comprise any suitable releasable attachment system, including without intending any limitation hook-and-loop material panels, one or more buttons, one or more snaps, one or more straps, a pouch or pocket, and combinations. In an embodiment, the body portion 150*a* . . . *n* and at least a portion of the cuff portion 140 are folded or rolled up for storage in or on the glove member retainer 152 (see FIG. 3, arrow).

In the depicted embodiment of FIG. 1, the garment 100 is provided including three distinct glove members 130*a*, 130*b*, and 130*c* each defining a different type of glove structure, although as discussed above more or fewer glove members may be included. As shown in greater detail in FIGS. 2A-2D, glove member 130*a* (see FIG. 2A) may be provided as a fingerless glove, which as is known includes a body portion 150*a* that covers the palm and back of the hand but only a portion of the fingers F. Glove member 130*b* (see FIG. 2B) may be provided as a full glove including a body portion 150*a* and full fingers 160. In the depicted embodiment, glove member 130*b* is provided as a thinner glove, providing protection and warmth to the hand of the user but being sufficiently thin whereby manual dexterity of the user is not significantly impaired.

Figure 2A:
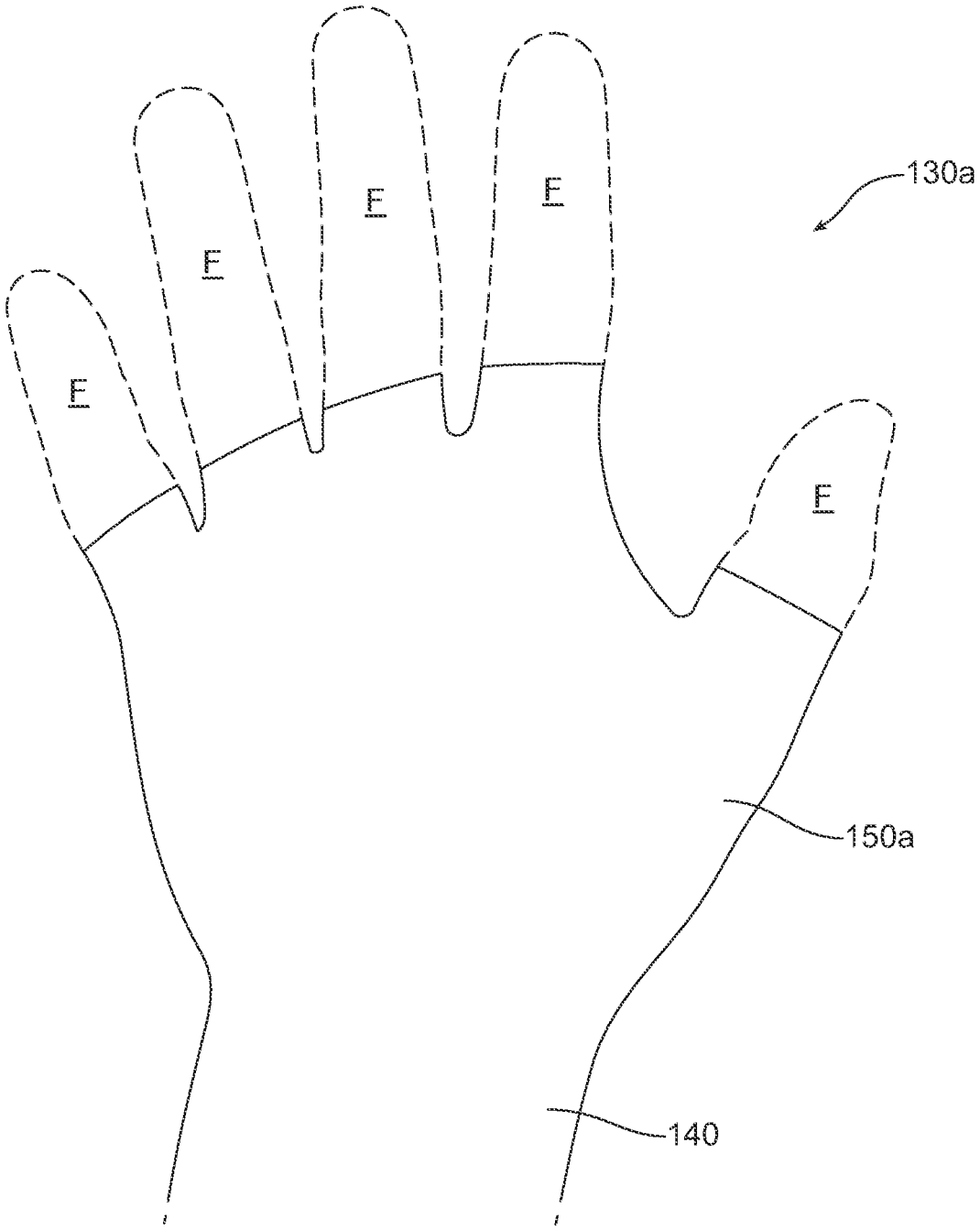
FIG. 2A is a front view of one embodiment of a glove member, configured as a fingerless glove.
Figure 2B:
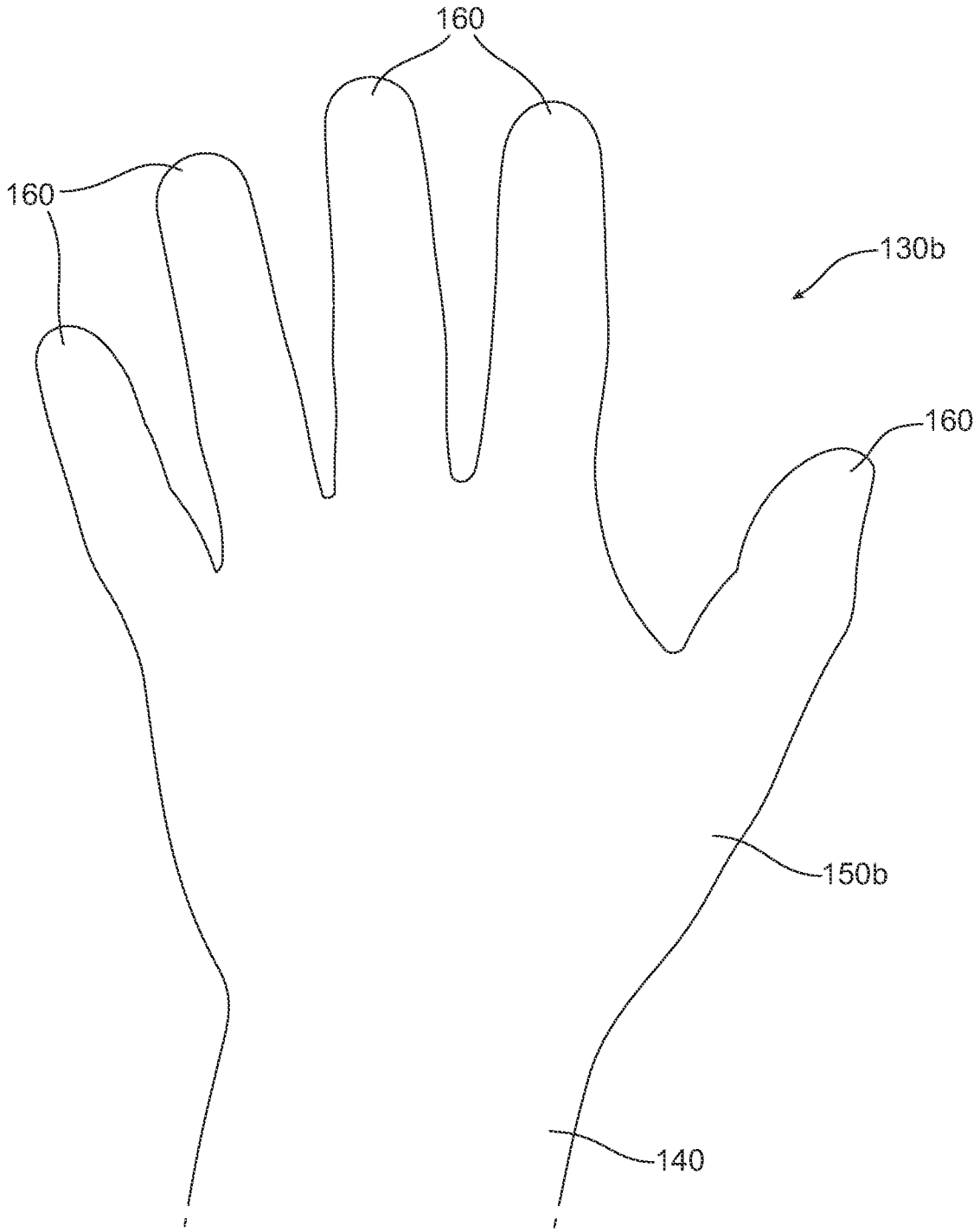
FIG. 2B is a front view of one embodiment of a glove member, configured as a full-fingered glove.
Figure 2C:
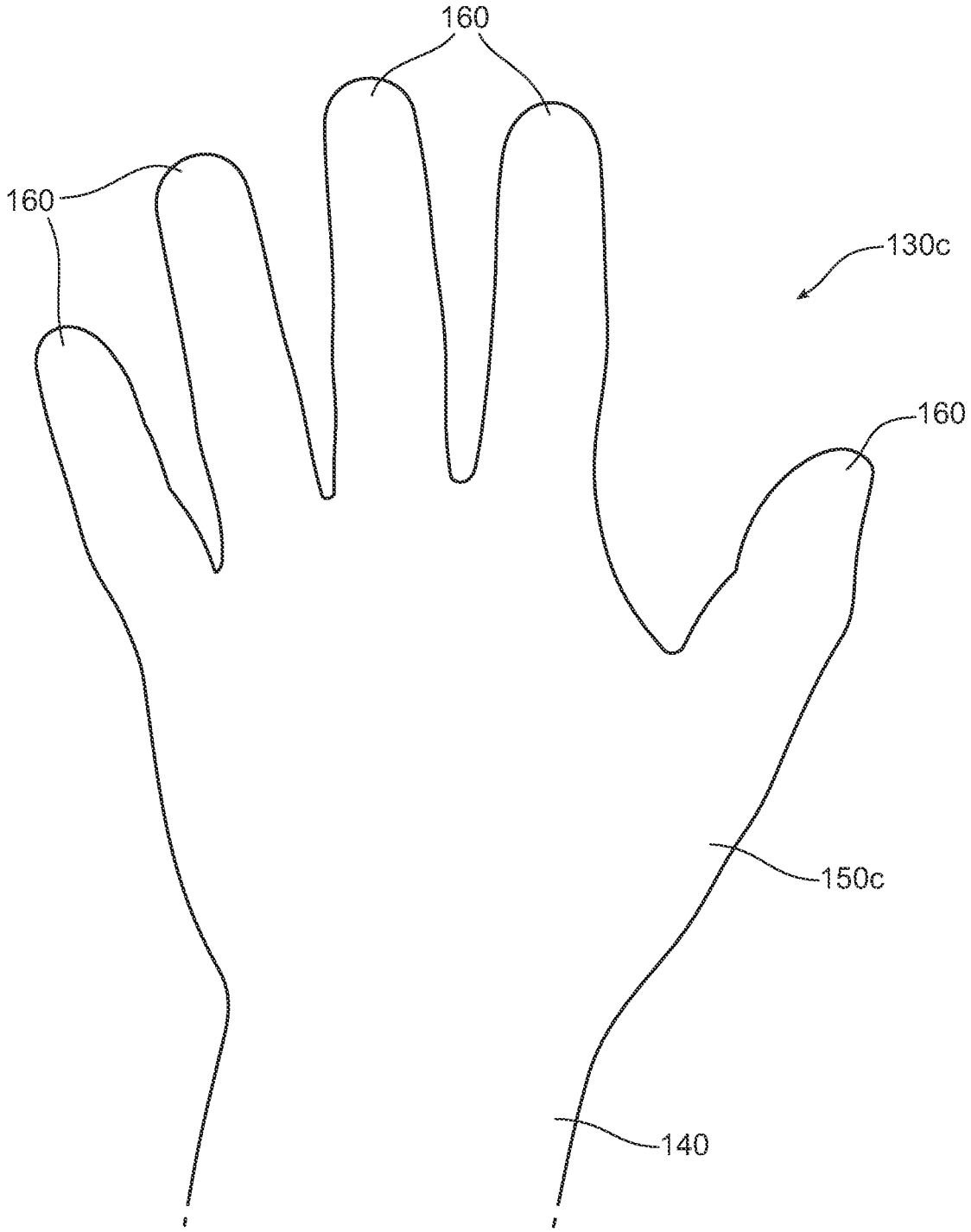
FIG. 2C is a front view of one embodiment of a glove member, configured as full-fingered glove.
Figure 2D:
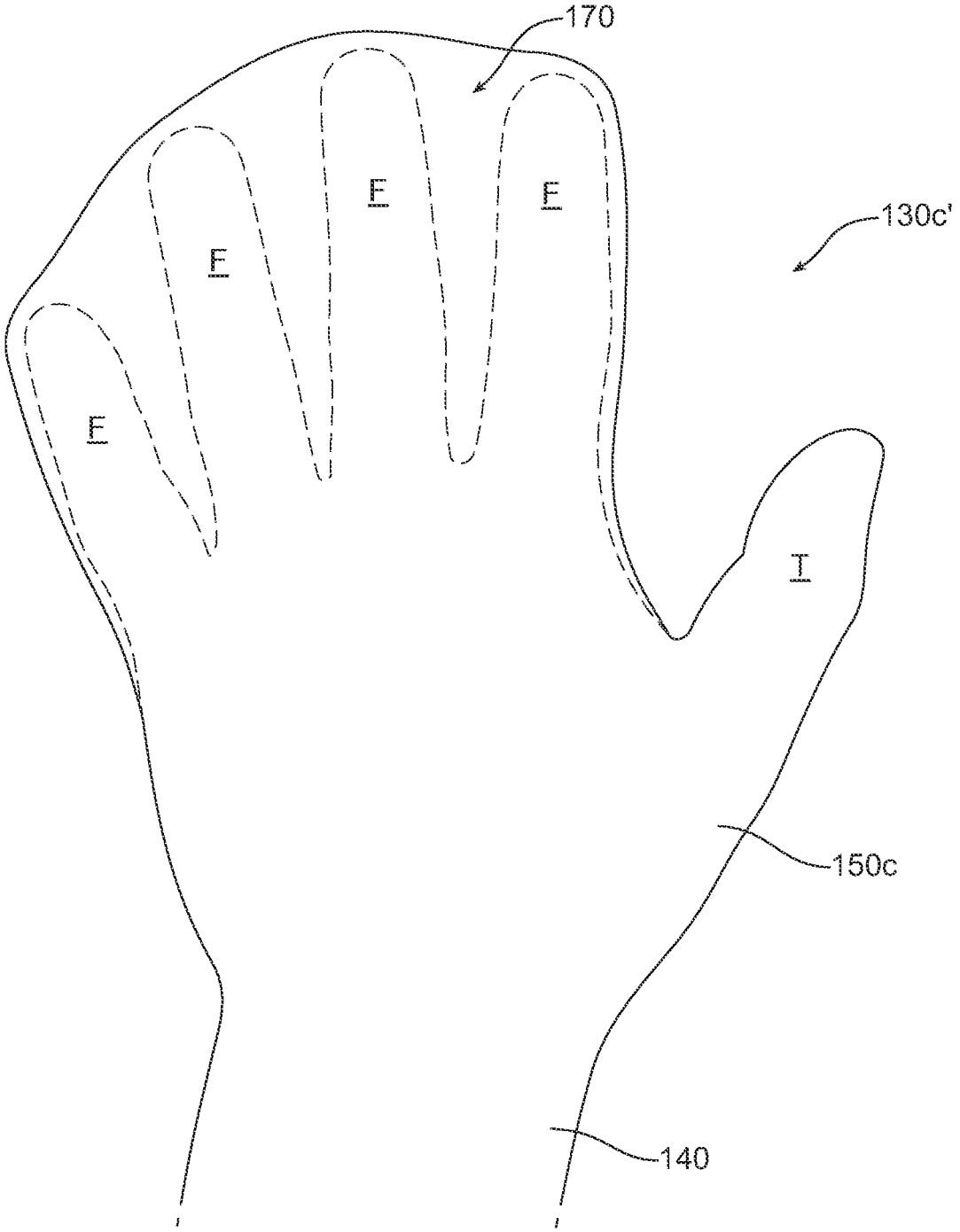
FIG. 2D is a front view of one embodiment of a glove member, configured as a mitten.

Glove members 130*c*, 130*c*' (see FIGS. 2C and 2D) are intended to provide the greatest amount of protection and/or warmth to the user's hand, but potentially cause an increased degree of impairment of manual dexterity. As one example, glove member 130*c* may be a full-fingered glove substantially similar in structure to glove member 130*b* (see FIG. 2B), but fabricated of a warmer and/or thicker combination of materials to increase warmth/protection. Alternatively, as shown in FIG. 2D glove member 130*c*' may define a mitten, which as is known covers the user's entire hand, lacks separate finger portions, but typically includes a thumb portion T as shown in the drawing. As is known, a mitten is typically warmer than a glove because it defines a single chamber 170 for the back of the hand, palm, and fingers. The chamber 170 traps and retains body heat generated by the user's hand and fingers more efficiently than the glove structures shown in FIGS. 2A-2C.

In use, the glove portions 130*a* . . . *n* may be used separately or together. For example, in cool weather only glove member 130*a* may need to be deployed and placed on the user's hand, whereas in slightly colder weather glove member 130*b* may be deployed. In turn, in much colder weather glove member 130*c* providing the most warmth to the user's hand may be deployed.

Still more, it is contemplated to deploy the glove portions 130*a* . . . *n* not only alone, but in combination according to the user's needs. Thus, for example, in extremes of cold weather some or all of glove portions 130*a* and 130*c* or 130*c*' may be concurrently deployed and placed on a user's hand to provide additional warmth. If the user engages in a task requiring more manual dexterity, the glove portion 130*c*/130*c*' may be removed from the hand, and restored once the task is completed.

Figure 4A:
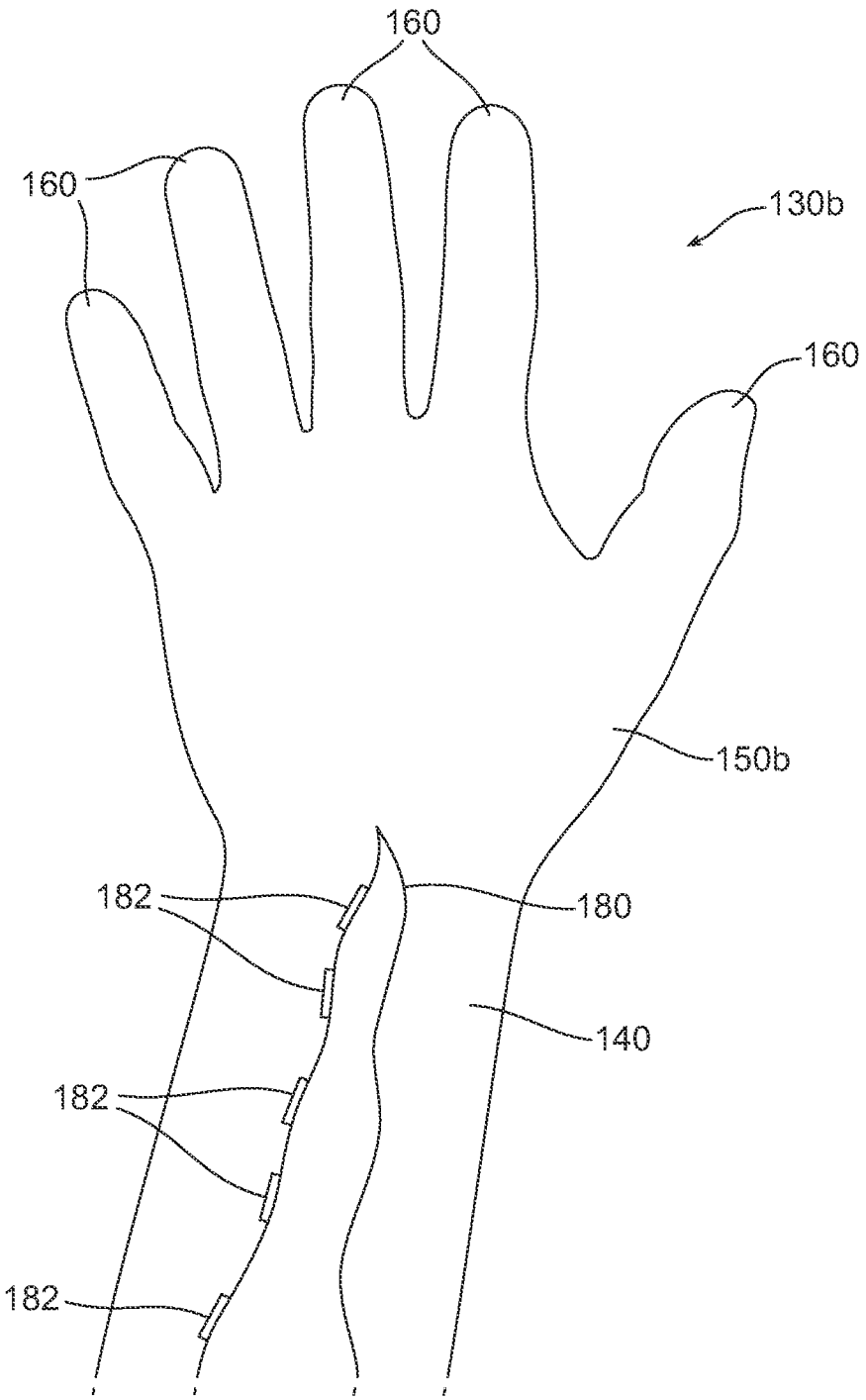
FIG. 4A shows an embodiment of a glove member according to the present disclosure.
Figure 4B:
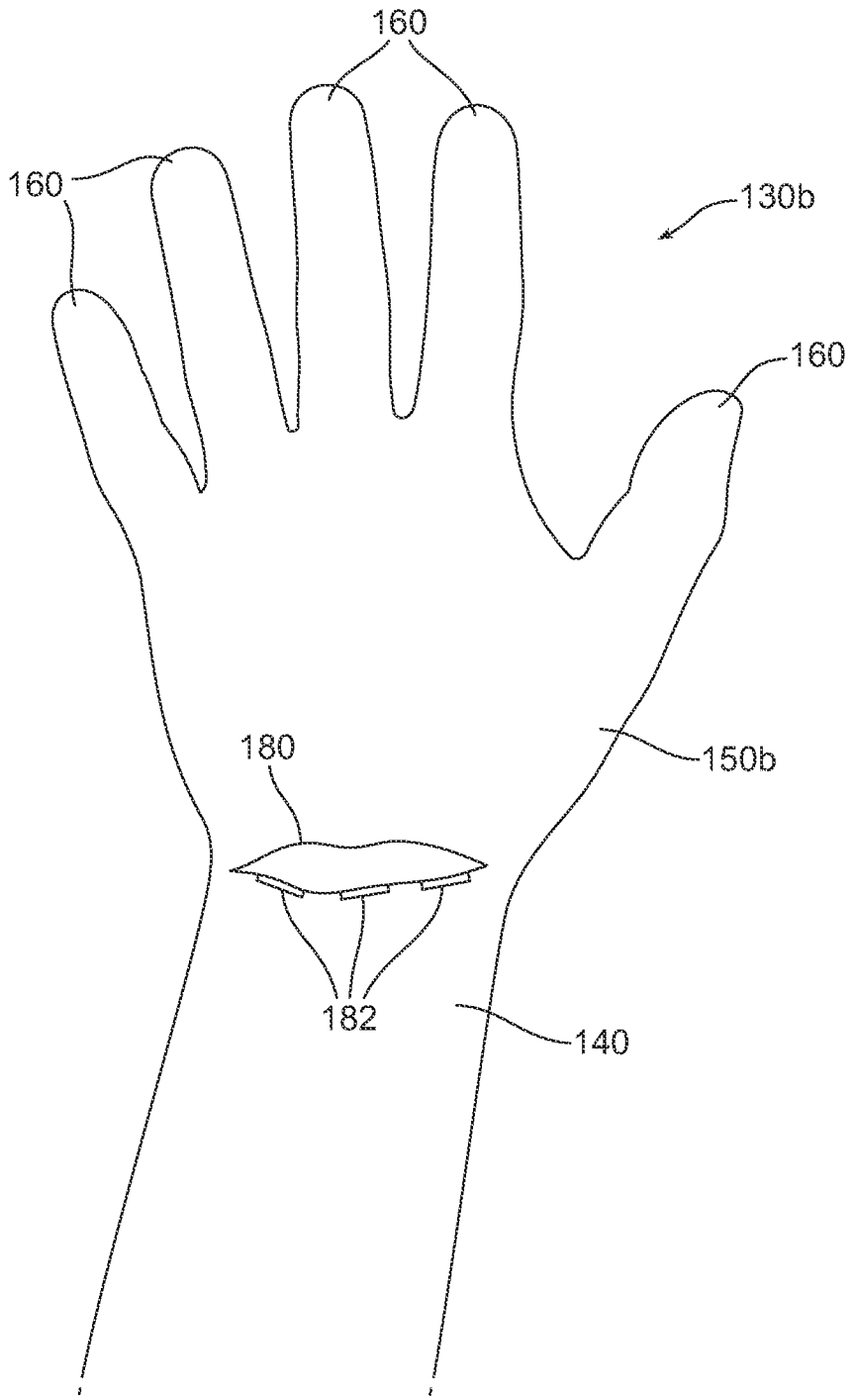
FIG. 4B shows an alternative embodiment of the glove member of FIG. 4A.

As will be appreciated, particularly in the case of children or the elderly, it may be difficult to slip a glove member 130*a* . . . *n* onto a user's hand. To solve this problem, the described glove members 130*a* . . . *n* may further include a slit 180 disposed in a portion of the glove cuff 140 and/or the glove body 150*a* . . . *n*. The slit 180 may be adapted to be selectively sealable by providing one or more sealing members 182. While the depicted embodiments show a plurality of sealing members 182, it will be appreciated that in embodiments a single sealing member 182 traversing a length dimension of the slit 180 may be provided. In embodiments, the sealing member(s) 182 may be provided as buttons, snaps, zippers, hook-and-loop material panels, and combinations. In one possible embodiment, the slit 180 is oriented along a longitudinal axis of the glove member 130*a* . . . *n* (see FIG. 4A). In another possible embodiment, the slit 180 is oriented along a transverse axis of the glove member 130*a* . . . *n* (see FIG. 4B).

The foregoing has been presented for purposes of illustration and description. It is not intended to be exhaustive or to limit the embodiments to the precise form disclosed. Obvious modifications and variations are possible in light of the above teachings. All such modifications and variations are within the scope of the description and appended drawings when interpreted in accordance with the breadth to which they are fairly, legally and equitably entitled.

What is claimed is:

1. A garment, comprising:

a pair of sleeves;

a plurality of gloves associated with each of the pair of sleeves by:

a first, non-releasable attachment directly attaching a first cuff portion of each of the plurality of gloves to a one of the pair of sleeves; and a second, releasable attachment provided by a cooperating glove retainer carried by each one of the pair of sleeves and adapted for releasably holding a second portion of each of the plurality of gloves to a respective one of the pair of sleeves by folding or rolling and securing the gloves by the cooperating glove retainer.

2. The garment of claim 1, wherein the second portion comprises a glove body configured for covering at least a portion of a user's hand.

3. The garment of claim 1, wherein the cuff portion is dimensioned to allow the glove body to reach the user's hand for wearing.

4. The garment of claim 2, wherein the glove body is configured as a fingerless glove.

5. The garment of claim 2, wherein the glove body is configured as a full-fingered glove.

6. The garment of claim 2, wherein the glove body is configured as a mitten.

7. A garment comprising:

a pair of sleeves;

a plurality of gloves each associated with each of the pair of sleeves by: a first, non-releasable attachment directly attaching a first cuff portion of each of the plurality of gloves to the pair of sleeves; and a plurality of releasable attachments provided by a plurality of glove retainers each carried by the pair of sleeves and adapted for releasably holding a second portion of each of the plurality of gloves to a respective one of the pair of sleeves by folding or rolling the second portion and securing by one of the plurality of glove retainers.

8. The garment of claim 7, wherein the plurality of glove retainers are selected from a group of glove retainers consisting of a closeable pouch or pocket, a hook-and-loop material panel, one or more buttons, one or more snaps, a strap, or combinations.

9. The garment of claim 7, wherein the second portion comprises a glove body configured for covering at least a portion of a user's hand.

10. A garment, comprising:

a garment body;

a pair of sleeves each attached to a portion of the garment body;

a plurality of gloves each including a first attachment provided by a glove cuff non-releasably and directly attached to each of the pair of sleeves and a glove body configured for covering at least a portion of a user's hand; and a plurality of second, releasable attachments provided by a plurality of glove retainers carried by each of the pair of sleeves, adapted for releasably holding the plurality of gloves by folding or rolling and securing the folded or rolled plurality of gloves by the plurality of glove retainers;

wherein each of the plurality of gloves includes a selectively sealable slit adapted for insertion of a user's hand therethrough.

11. The garment of claim 10, wherein the selectively sealable slit includes one or more fasteners selected from the group consisting of a button, a snap, a zipper, a hook-and-loop material panel, and combinations.

12. The garment of claim 10, wherein the plurality of glove retainers are selected from the group of retainers consisting of a closeable pouch or pocket, a hook-and-loop material panel, one or more buttons, one or more snaps, a strap, or combinations.

13. The garment of claim 10, the plurality of gloves variously include the glove body configured from the group of glove bodies consisting of a fingerless glove, a full-fingered glove, a mitten, and combinations.

14. The garment of claim 10, wherein the plurality of gloves are configured and dimensioned to allow concurrent placement of two or more of the plurality of gloves on a user's hand.

* * * * *